US007694369B2

(12) United States Patent
Hinders et al.

(10) Patent No.: US 7,694,369 B2
(45) Date of Patent: Apr. 13, 2010

(54) CONFIGURABLE BOLSTER FOR OPERATIVE AND THERAPEUTIC PROCEDURES

(75) Inventors: Sharon Hinders, P.O. Box 680564, San Antonio, TX (US) 78268-0564; Jane Bugtel, San Antonio, TX (US)

(73) Assignee: Sharon Hinders, San Antonio, TX (US)

( * ) Notice: Subject to any disclaimer, the term of this patent is extended or adjusted under 35 U.S.C. 154(b) by 1220 days.

(21) Appl. No.: 11/150,892

(22) Filed: Jun. 13, 2005

(65) Prior Publication Data

US 2006/0278237 A1 Dec. 14, 2006

(51) Int. Cl.
*A47B 7/02* (2006.01)

(52) U.S. Cl. ..... 5/613

(58) Field of Classification Search ..... 5/710, 5/713, 727, 740, 731, 607, 611, 83.1, 86.1, 5/621, 623, 624, 632, 613, 617, 600, 638, 5/461, 465, 431, 436, 437, 440, 445
See application file for complete search history.

(56) References Cited

U.S. PATENT DOCUMENTS

| | | | | |
|---|---|---|---|---|
| 2,234,506 A | | 3/1941 | Sistig | 5/327 |
| 2,314,080 A | | 3/1943 | Dine et al. | 5/327 |
| 2,521,530 A | | 9/1950 | McGuffage et al. | 5/327 |
| 3,604,023 A | | 9/1971 | Lynch | 5/327 |
| 3,931,654 A | | 1/1976 | Spann | 5/327 |
| 3,938,205 A | | 2/1976 | Spann | 5/327 |
| 4,185,813 A | | 1/1980 | Spann | 269/328 |
| 4,233,700 A | | 11/1980 | Spann | 5/431 |
| 4,471,952 A | | 9/1984 | Spann | 269/328 |
| 4,482,138 A | | 11/1984 | Spann | 269/328 |
| 4,752,064 A | | 6/1988 | Voss | 269/328 |
| 4,840,362 A | * | 6/1989 | Bremer et al. | 5/632 |
| 4,969,222 A | | 11/1990 | Serola | 5/431 |
| 5,014,375 A | | 5/1991 | Coonrad et al. | 5/431 |
| 5,097,847 A | | 3/1992 | Mikhail et al. | 128/848 |
| 5,131,106 A | * | 7/1992 | Jackson | 5/613 |
| 5,454,993 A | | 10/1995 | Kostich | 264/46.4 |
| 5,467,782 A | | 11/1995 | Wiseman | 128/845 |
| 5,566,682 A | | 10/1996 | Yavitz | 128/845 |
| D387,167 S | | 12/1997 | Klein | D24/183 |
| D396,373 S | | 7/1998 | Reale | D6/601 |
| 6,032,669 A | | 3/2000 | Klein | 128/845 |
| 6,047,419 A | | 4/2000 | Ferguson | 5/630 |
| 6,357,066 B1 | * | 3/2002 | Pierce | 5/710 |

(Continued)

OTHER PUBLICATIONS

Catalog Sheets "Specialty Blocks" offered by Pacific Northwest X-Ray, Inc., P.O. Box 625, Gresham, Oregon 97030; Apr. 2006; www.pnwx.com; 5 pp.

*Primary Examiner*—Manuel A Mendez
(74) *Attorney, Agent, or Firm*—Whitaker, Chalk, Swindle & Sawyer, LLP; Stephen S. Mosher

(57) ABSTRACT

A device for providing anatomical support during operative or therapeutic procedures comprising a configurable bolster formed from a block of resilient synthetic foam material and having a plurality of recessed regions formed in the top surface of the bolster and extending into selected portions of the bolster for accommodating particular anatomical structures. Precut slits are provided extending vertically upward from the bottom surface of the bolster to enable removal of material from the bolster to adapt it to particular circumstances of use.

29 Claims, 3 Drawing Sheets

U.S. PATENT DOCUMENTS 6,446,288 B1 9/2002 Pi ..... 5/636
6,553,995 B1 4/2003 Cole et al. ..... 128/846
6,557,197 B1 5/2003 Graham ..... 5/630
6,561,194 B2 5/2003 Michelson ..... 128/845
6,625,831 B2 9/2003 Laughlin ..... 5/655.9
2003/0159699 A1 8/2003 Anderson et al. ..... 128/845

* cited by examiner

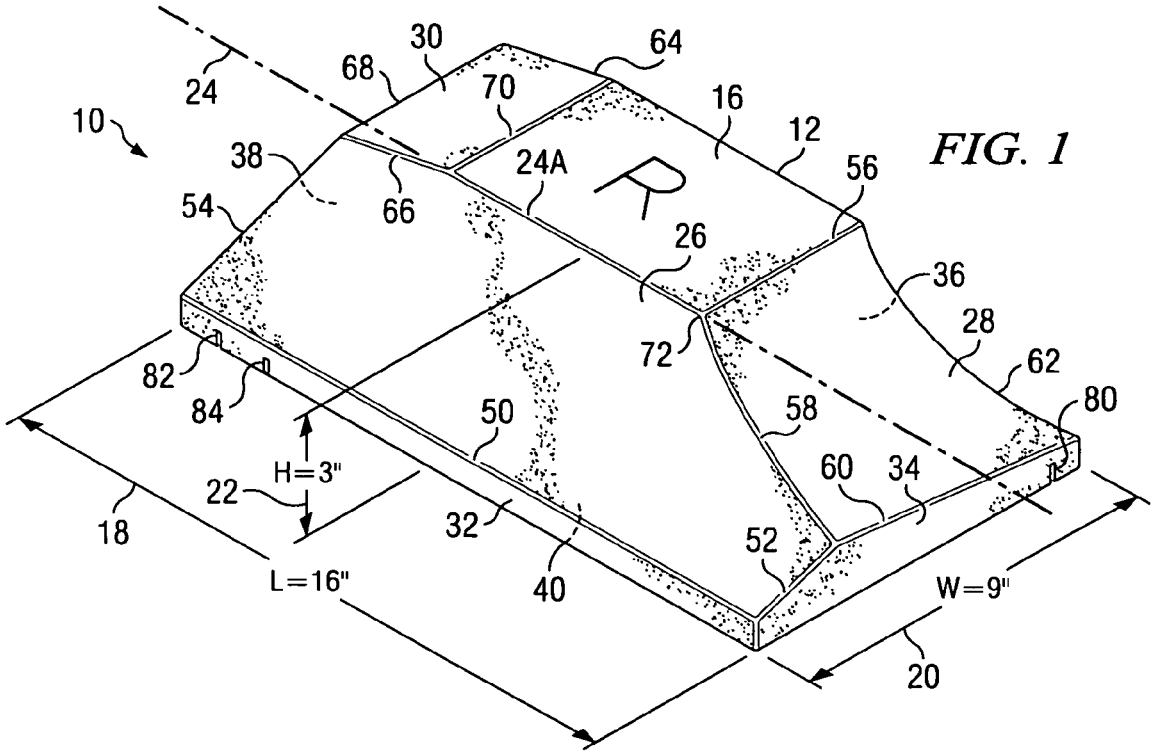
FIG. 1
FIG. 3
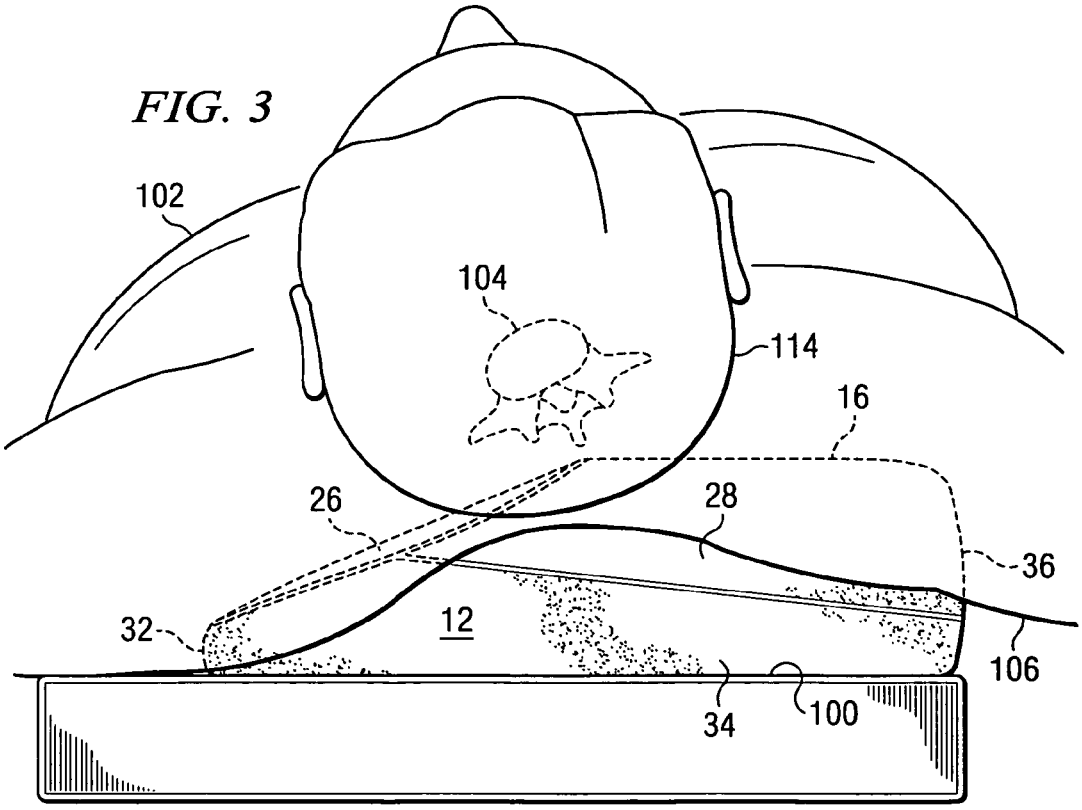

CONFIGURABLE BOLSTER FOR OPERATIVE AND THERAPEUTIC PROCEDURES

BACKGROUND OF THE INVENTION

1. Field of the Invention

The present invention generally relates to anatomical support structures used during medical procedures and, more particularly, to devices for supporting and positioning portions of a patient's body when undergoing surgery or other therapeutic procedures.

2. Background and Description of the Prior Art

During certain operative and therapeutic medical procedures it is necessary to position the patient, or selected portions of the patient's body, in specific orientations to facilitate performing the procedure or to minimize discomfort or possible injury to the patient. For example, when positioning a patient for thoracic surgery such as a robotic heart surgery procedure, stability of the patient is critical and requires the patient to be positioned at a stable angle of approximately 30 degrees, usually with the patient's right side elevated with respect to his or her left side. In some cases it is also necessary to perform some manipulation of the patient's elevated shoulder to allow the robotic trocars to move freely. As is known in the medical arts, a trocar is a surgical instrument having a cutting end with a three-sided blade and enclosed within a cannula (a small tube). The trocar may be used for manipulating or cauterizing tissue, and removing tissue and fluids. In other cases, stable anatomical support is needed to position the patient in a comfortable position even though the patient is required to remain immobile for an extended period of time. In many thoracic and orthopedic procedures, for example, correct support is needed for the patient's back and legs, respectively. In still other circumstances, such as certain obstetric procedures, a patient must be positioned so as to avoid pressure on certain internal organs or other structures.

Heretofore, patients have been positioned for thoracic or orthopedic surgery using improvised devices such as air bags, intravenous (IV) fluid bags, rolled-up sheets, and the like. These devices have proved to be unreliable in practice. For example, the air bags and the IV fluid bags run the inherent risk of leakage or rupture during the procedure. Such failure can cause an abrupt change in the position or orientation of the patient with possible catastrophic results. Further, none of the above improvised devices provide correct anatomical support of both the lower back and the upper back as required when performing thoracic surgery procedures. Moreover, in order to correctly position the patient using improvised devices, operating room personnel must spend too much time adjusting and maneuvering these devices during the critical pre-incision period, increasing the risk to the anesthetized patient due to prolonging the anesthesia and to the uncertain stability. Such delays decrease the productivity for surgeons, anesthesiologists, other operating room personnel, and in some cases, support personnel. Another shortcoming of improvised devices is that pressure exerted by the devices may result in discomfort or injury because the pressure is not evenly distributed, is not properly located, or the device shifts position during the procedure. Further, when using improvised devices it is difficult to avoid pressure points that may cause burns when used with heating pads between the patient's body and the positioning device.

In an effort to overcome the deficiencies of improvised devices, a number of prior art pads, pillows, supports, positioners, etc. have been devised, some of them with specific shapes adapted to specific procedures. Such devices tend to be limited to specific uses for which they were constructed, requiring a number of variations to be inventoried or made available to satisfy a variety of conditions, in turn requiring substantial storage space and handling procedures. Others require the use of a plurality of devices in combinations to achieve the desired support, but have the disadvantage that the combination lacks the needed stability or is unable to maintain the correct anatomical support for long periods.

What is needed, therefore, is a device that optimizes the shape requirements of thoracic, abdominal, and orthopedic procedures with a single anatomical support device, is readily adaptable or configurable to minor variations in patient's bodies or medical procedures, and reliably provides the stability needed during critical robotic procedures and other operative and therapeutic procedures.

SUMMARY OF THE INVENTION

Accordingly there is disclosed a device for providing anatomical support during operative or therapeutic procedures comprising a configurable bolster formed from a block of resilient synthetic foam material having a top reference surface and respective length, width, and height dimensions, and a plurality of recessed regions formed in the top reference surface of the configurable bolster and extending into selected portions of the bolster for accommodating particular anatomical structures. Precut slits may be provided extending vertically upward from the bottom surface of the bolster to enable removal of material from the bolster to adapt it to particular circumstances of use.

In another aspect, there is disclosed a device for providing anatomical support during operative or therapeutic procedures comprising: a configurable bolster formed from a block of resilient synthetic foam material having a top reference surface and respective length, width, and height dimensions before being formed, and further having: a first recessed portion of the top reference surface configured by a first beveled region sloping downward from a longitudinal centerline of the top surface of the bolster and descending laterally across a first half of the width dimension to and along a first side of the bolster; a second recessed portion of the reference surface configured as a concave relief sloping longitudinally downward from a first intermediate boundary of the top surface to a first end of the bolster and laterally downward from an intersection of the second recessed portion with the first beveled region to a second side of the bolster; and a third recessed portion of the reference surface configured by a second beveled region sloping downward, descending across the second half of the width dimension from approximately a second intermediate boundary of the top surface to a second end of the bolster.

In another aspect, precut slits are provided extending vertically upward from the bottom surface of the bolster to enable removal of material from the bolster to adapt it to particular circumstances of use.

BRIEF DESCRIPTION OF THE DRAWINGS

FIG. 1 illustrates a perspective view of one embodiment of a configurable bolster according to the present invention;

FIG. 3 illustrates a head end view of the arrangement of FIG. 2; and

DETAILED DESCRIPTION OF THE INVENTION

Figure 2:
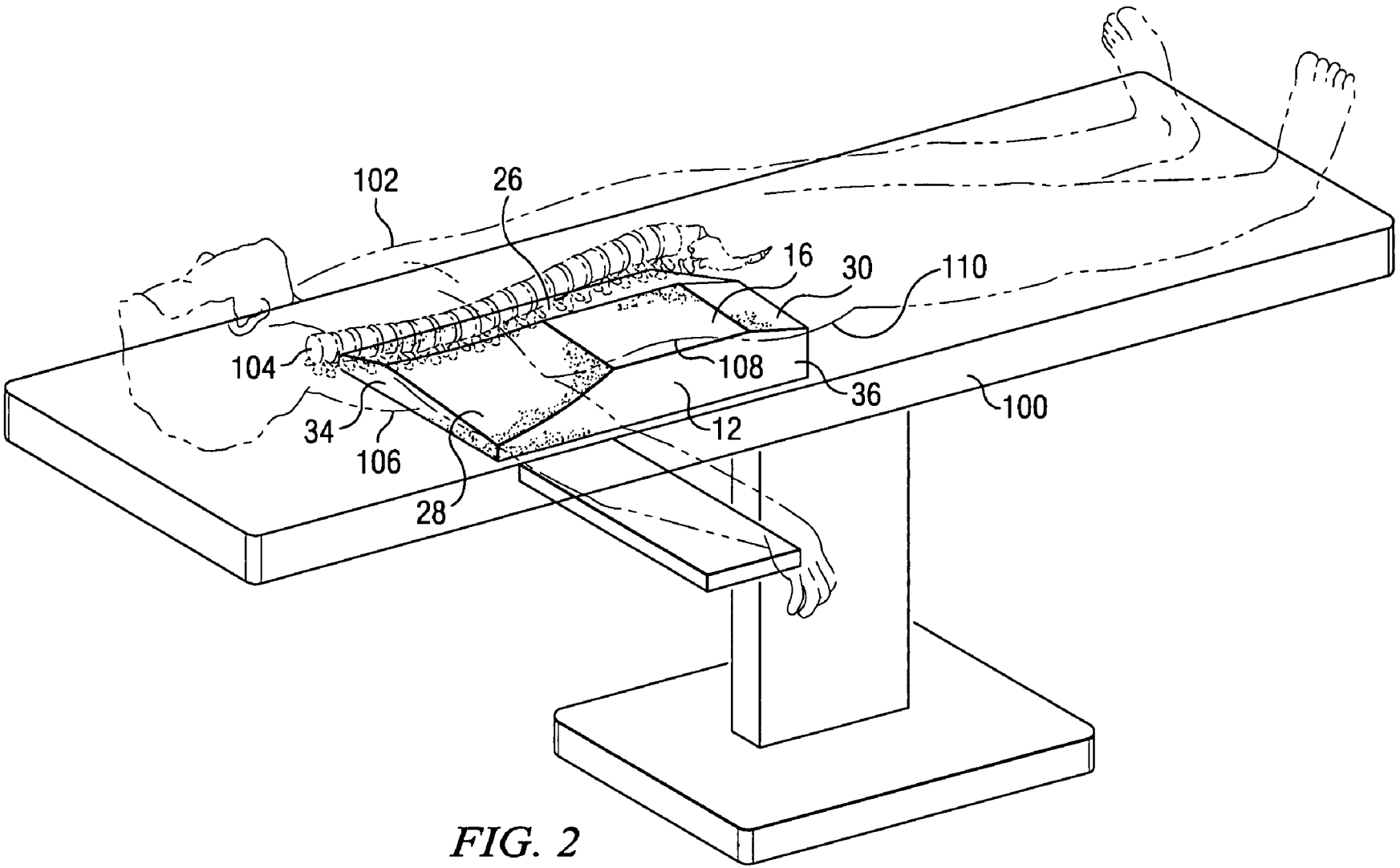
FIG. 2 illustrates a perspective view of a patient on an operating table with a configurable bolster according to the present invention in place under the patient's right side torso.

Referring to FIG. 1, there is illustrated a perspective view of one embodiment of a configurable bolster according to the present invention. The configurable bolster may be available in two versions, a "right" version that may be identified with a suitable mark such as a letter R on its surface, as shown in the figure, and a "left" version that also may be identified with a suitable mark such as a letter L on its surface. As will be appreciated, the "left" version is a mirror image of the "right" version. The choice of version, "R" or "L," depends on the desired position of the operative side of the patient's body that is the site of the operative procedure. The two versions may further be available in several degrees of firmness, as will be described. The embodiment of the configurable bolster described herein may also be used in at least two placements, one under the torso or thorax of a patient's body and another under a patient's hip and thigh.

The present invention is not intended to be limited to the one illustrated; rather the one described herein is provided to show one example of a configurable bolster and its uses. Among, but not limited to, the operative procedures that may employ the configurable bolster to advantage are robotic heart surgery (e.g., mitral valve replacement), thoracotomies, thoracoscopies, radical and modified mastectomies, breast biopsies, skin grafting, kidney procedures, and orthopedic procedures involving knee surgery, fractured ankles, etc. The bolster described herein has also been found to be useful during abdominal procedures on pregnant patients to prevent compression of the patient's aorta (a condition called aorta-caval congestion) when the patient prefers to be supine. Although the bolster may be fashioned of reusable materials, the preferred embodiment of the invention is intended to be disposable, for single use only.

A configurable bolster 10 is shown in FIG. 1 as a right side "R" embodiment 12 (herein after, bolster 12). The bolster 12 may generally be formed from a single rectangular block of resilient synthetic foam material having a uniform density such as polyurethane foam. The single block construction eliminates the possibility that one of several improvised items used together for positioning may slip out of position, causing an abrupt change of position of the patient. Moreover, the material selected provides a positioning device that will not collapse or shift position unexpectedly because of its unitary construction and non-slip surfaces. The material selected should have a antimicrobial additive to resist bacterial and fungal invasion. Further, the material must comply with the requirements of a standard flame resistance test such as the California Tech Bulletin #117, Sections A & D. The indention force deflection (IDF) at 25% deflection should be within the range of 30 to 50 pounds per inch, as performed according to the ASTM test method No. D3574-03, Test B. In one preferred embodiment, the material selected has a density of approximately 2.5 pounds per cubic foot (2.5 pcf), and may vary between 2.0 and 3.0 pcf. In another embodiment, the material selected has a density of approximately 1.5 pounds per cubic foot (1.5 pcf), and may vary between 1.0 and 2.0 pcf. The higher density may be designated for use in a "firm" model, and may be used for placements under a person's thorax or hip. The lower density may be designated for use in a "soft" model used for lighter weight patients or in support of procedures wherein the patient's leg or hip must be elevated or positioned at an angle.

For example, the more dense version may also be recommended for use with pregnant women, or to provide greater stability when the bolster is in place. In another example, the less dense version may be more suitable for patients that must be propped up off their back for limited periods. In either version, the density specification is chosen to provide a relatively firm bolster that has adequate stability to maintain its position while the operative or recovery procedure(s) are being performed. With either density, however, the use of the bolster will be determined by the physician and tailored to the particular patient and the specific procedure. For example, with older patients having skin that is less robust than usual, nurses may be instructed to turn the patient frequently—e.g., every two hours—to prevent "decubitus," a breakdown of the skin caused by prolonged or excess pressure at bony regions of the patient's body such as the scapula, hip bones, or coccyx. In such cases the softer density version may be prescribed.

In fabricating the bolster 12, it may be cut from the rectangular block using hot knives, hot wire cutting apparatus or other suitable tool. In this illustrative example, the rectangular block of resilient foam may be preferably precut to the approximate length (L) 18, width (W) 20, and height (H) 22 dimensions before being shaped to the specified shape. Further, the dimensions selected for the embodiment illustrated are those that accommodate a patient of average size and weight. The proportions and contours, and the durometer of the foam material utilized, of the bolster to be described may readily be scaled for use with much larger or much smaller patients. Alternatively, the bolster 12 may be molded in the shape illustrated by molding processes well known in the art. In an alternate embodiment suited for some applications, the shaped bolster 12 may be covered with a permanent or temporary covering of cloth, vinyl, or other plastic material.

Continuing with FIG. 1, the approximate overall dimensions of the illustrative embodiment have been given as length (18)=16 inches, width (20)=9 inches, and height (22)=3 inches. These dimensions are nominal and may be altered to suit particular circumstances. The bolster 12 includes specific contours chosen to provide correct anatomical support, stability during use, ability to manipulate a patient's arm or shoulder as needed without loss of support of other parts of the patient's body, while also providing secure positioning without pressure points, and generally maintaining the patient as comfortable as possible during the procedure being performed. The contours of the bolster 12 are defined by a top surface 16 having a longitudinal centerline 24 that is used as a convenient reference for describing a first recessed portion 26, a second recessed portion 28, and a third recessed portion 30 that are provided to accommodate various anatomical parts of a patient's body. The bolster 12 also has parallel first 32 and second 36 sides, parallel first 34 and second 38 ends, and a bottom surface 40 that is substantially parallel to the top surface 16.

The first (or lateral) recessed portion 26 of the bolster 12 may be configured as a first beveled region (a descriptive name for the first recessed portion 26, which may be used interchangeably therewith) that slopes downward from the longitudinal centerline 24, forming a first inner edge 24A of the top surface 16 there along, and descends laterally downward across a first half of the width 20 of the bolster 12 to intersect with the first side 32 of the bolster 12. The second (or scapular) recessed portion 28 of the bolster 12 may be configured as a concave relief region (a descriptive name for the second recessed portion 28, which may be used interchangeably therewith) that slopes longitudinally downward from a first intermediate line 56, forming a second inner edge 56A of the top surface 16, that is disposed in the plane of the top surface, that intersects the longitudinal centerline 24 at a right angle, and that is located approximately six (6) inches from and parallel to the first end 34 of the bolster and ten (10)

inches from the second end 38 of the bolster 12. The second recessed portion 28 slopes with a downward curve toward the first end 34 and toward the second side 36 of the bolster 12, thereby providing the concave profile shown in FIG. 1. The profile of the second recessed (concave) portion may be spherical having a radius of approximately ten (10) inches, or it may have a more complex curvature in cross-section such as a second order exponential of the form y=x squared, where the x axis corresponds to a line perpendicular to both the longitudinal centerline 24 and the first intermediate line 56 at the point where these two lines intersect 72 and extending downward in the figure, the y axis corresponds to a line coincident with the longitudinal centerline 24, and the origin is located at the intersection 72 of the longitudinal centerline 24 and the first intermediate line 56.

The third recessed portion 30 of the bolster 12 may be configured as a second beveled region (a descriptive name for the third recessed portion 30, which may be used interchangeably therewith) that slopes downward from a second intermediate line 70, forming a third inner edge 70A along the top surface 16, and descends longitudinally downward across the second half of the width 20 of the bolster 12 to intersect with the second end of the bolster 12. In the foregoing, the second intermediate line 70 is disposed in the plane of the top surface, intersects the longitudinal centerline 24 at a right angle, and is located approximately thirteen (13) inches from and parallel to the first end 34 of the bolster and three (3) inches from the second end 38 of the bolster 12 at the third inner edge 70A of the top surface 16. Thus, the length of the bolster 12 between the second intermediate line 70 and the second end 38 of the bolster, in the illustrated example, defines a segment that is three-sixteenths (0.1875) of the total length L (18) of the bolster 12, or, by rounding off, approximately 0.200 times or one-fifth of the total length L (18) of the bolster 12.

Continuing with FIG. 1, the configurable bolster 10 may include one or more precut slits in the bottom surface 40 of the bolster 12. The precut slits may be provided to enable easier removal of selected portions of the bolster 12 to configure the bolster 12 to particular conditions or size requirements. The precut slits may be provided during manufacture of the configurable bolster 10, or may be cut by hand at the time of use for an operative or therapeutic procedure using an electrically heated knife, for example. Removal of the sections of material may be removed by tearing, or cutting with a knife or scissors. In the illustrative embodiment shown in FIG. 1, a longitudinal slit 80 is provided from the first end 34 to the second end 38 of the bolster 12. The slit is formed upward from the bottom surface 40 of the bolster 12 to an approximate depth of one-half the height 22 of the bolster 12 along the line of the slit 80, except where the height 22 of the bolster in one of the recessed portions is less than one-half of the height 22 of the bolster 12. Similarly, a first lateral slit 82 and a second lateral slit 84 may be precut upward from the bottom surface 40 of the bolster 12 near the second end 38 of the bolster 12 and parallel to the second end 38, each spaced approximately 1.50 and 3.00 inches respectively from the second end 38 of the bolster 12. The depth of either lateral slit 82, 84 may be determined by the same rule applied to the longitudinal slit.

Referring to FIG. 2, there is illustrated a perspective view of a patient 102 on an operating table 100 in a supine position with a configurable bolster 12 according to the present invention in place under the patient's right side torso. Structures appearing in FIG. 2 that are identical with the structures described in FIG. 1 are identified with the same reference numbers. The patient 102 is shown in phantom to more clearly represent the placement of the bolster 12 under the patient's right side torso. The bolster is placed on the top of the operating table 100 and under the right side of the patient 102 to elevate the right side of the torso of the patient 102. The amount of elevation may vary, but in a typical procedure such as robotic heart surgery, the patient's torso may be tilted approximately 30 degrees. The position of the body of the patient is facilitated by the profile of the bolster 12, as described in the detailed description of FIG. 1. It will be appreciated that the bolster 12 is shaped and dimensioned to accommodate the various portions of the body of the patient 102. Also shown are phantom views of the patient's spine 104, right shoulder (or scapula) 106, the small of the back 108 and the buttocks 110, provided to facilitate visualization of the positioning of the configurable bolster 12.

In use, the bolster 12 is placed so that the patient's spine 104 is aligned substantially above and along the longitudinal center line (24 in FIG. 1) of the bolster 12. The first end 34 of the bolster 12 is positioned proximate the upper portion of the torso of the patient 102. The left side of the torso of the patient 102 is positioned on the first recessed portion 26 of the bolster such that the slope of the bolster encourages the torso of the patient to be tilted, or rotated to the left, substantially toward a 30 degree angle relative to the surface of the operating table. Similarly, the patient's right shoulder 106, including the scapula, is placed substantially within the second recessed portion 28 of the bolster 12. With this placement, the right side torso of the patient 102 will be substantially over the top surface 16 of the bolster and the patient's right side buttock 110 will be positioned just beyond the third recessed portion 30 of the bolster 12. In other words, the second end 38 of the bolster 12 is positioned approximately at the iliac crest (hip bone) and under the lumbar region (right side in the view of FIG. 2) of the patient's back. The recessed portions 26, 28, and 30, along with the top surface 16 are contoured to accommodate the topography of the patient's body and provide the desired amount of elevation to the right side of the torso so that it will be tilted or rotated the required amount. The foam structure of the bolster 12 enables providing the necessary rotation of the patient's torso in a comfortable manner. It will be appreciated that the patient's right arm is not supported by the bolster 12, but may be extended to the right, in a natural position and away from the body of the patient 102, or, alternatively, extended outward in a natural manner and positioned slightly below the torso to enable clear access to the patient's side. The arm may be supported by linens or in a sling (not shown) that may be installed alongside the operating table 100.

Referring to FIG. 3, there is illustrated a head end view of the arrangement of the bolster 12 with respect to the patient as shown in FIG. 2, with the configurable bolster 12 according to the present invention in place under the patient's right side torso. Structures appearing in FIG. 3 that are identical with the structures described in FIG. 1 are identified with the same reference numbers. The bolster 12 includes the first recessed area 26, the second recessed area 28, and the top surface 16, as well as the first side 32, first end 34, and second side 36 of the bolster 12. The right shoulder 106 of the patient is shown over the second recessed region 28 of the bolster 12. In the figure, the patient's head 114 is shown in an elevated position above the operating table 100. In practice the patient's head 114 is supported by a pillow, not shown in FIG. 3 to provide a clearer view of the relationship of the patient's torso and the bolster 12.

The bolster 12, shown partially in phantom, is placed on the top of the operating table 100 and under the right side of the patient 102 to elevate the right side of the torso of the patient 102. The amount of elevation may vary, but in a typical procedure such as robotic heart surgery, the patient's torso may be tilted approximately 30 degrees. The position of the body of the patient 102 is facilitated by the profile of the bolster 12, as described in the detailed description of FIG. 1. It will be further appreciated that the bolster 12 is shaped and dimensioned to accommodate the various portions of the body of the patient 102. Also shown is a phantom view of the patient's spine 104. The right shoulder 106 of the patient 102 is shown substantially above the left side of the top surface 16 of the bolster 12, along the longitudinal center line (24 in FIG. 1) of the bolster 12.

Figure 4:
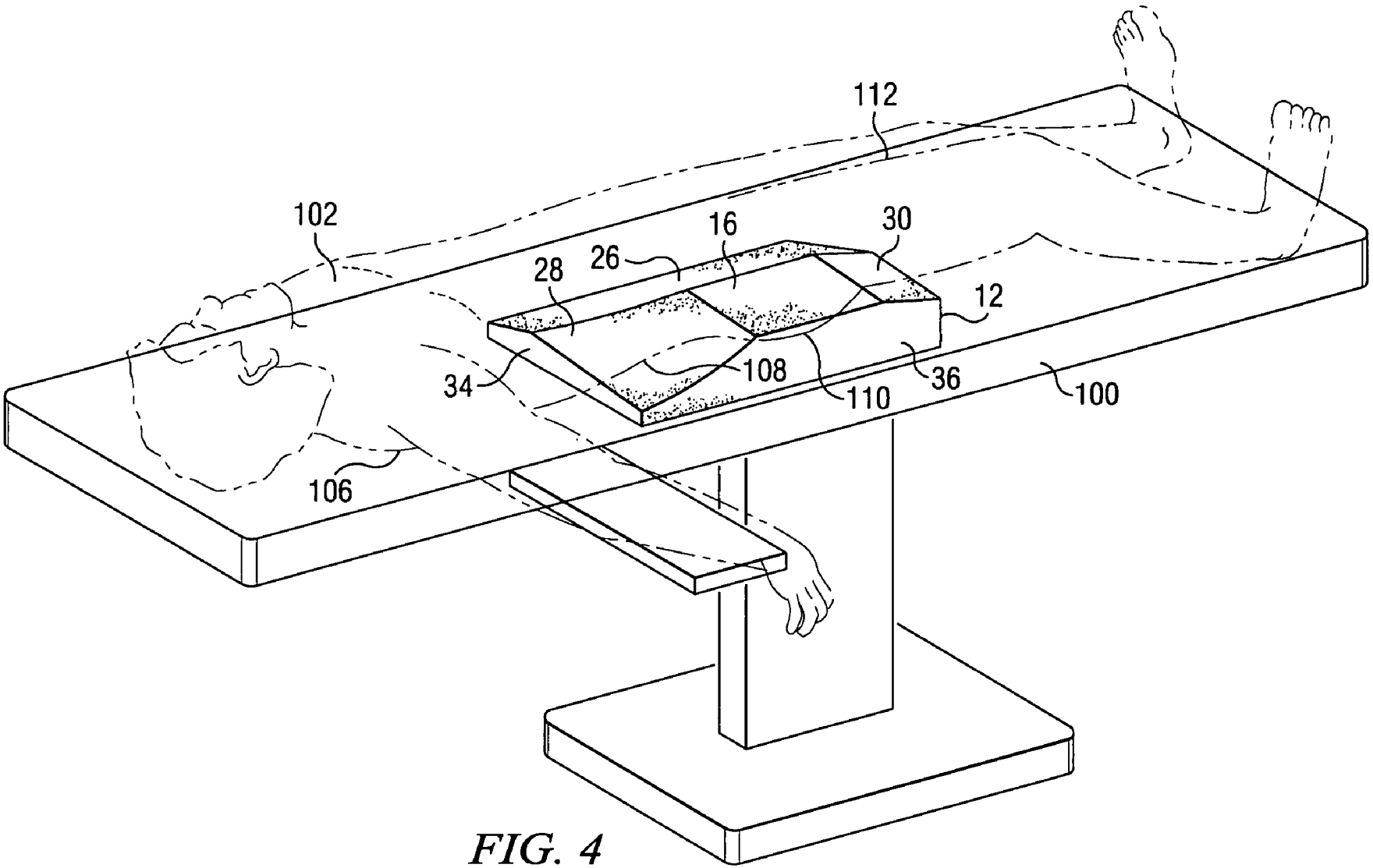
FIG. 4 illustrates a perspective view of a patient on an operating table with a configurable bolster according to the present invention in place under the patient's right side hip.

Referring to FIG. 4, there is illustrated a perspective view of the patient 102 on an operating table 100 with a configurable bolster 12 according to the present invention in place under the patient's right side leg 112. Structures appearing in FIG. 4 that are identical with the structures described in FIG. 1 are identified with the same reference numbers. The use illustrated in FIG. 4 may be advantageously employed during orthopedic procedures such as, e.g., knee or ankle surgery. With the placement shown, under a patient's buttock, for example, the patient's leg will be oriented with the toes pointing upward, which generally facilitates procedures on the ankle or lower leg. The patient 102 is shown in phantom to more clearly represent the placement of the bolster 12 under the patient's right side hip and thigh. The bolster 12 is placed on the top of the operating table 100 and under the right side of the patient 102 to elevate the right side hip of the patient 102. The amount of elevation may vary, but in a typical procedure such as knee surgery, the patient's hip may be tilted up to approximately 30 degrees. The position of the body of the patient 102 is facilitated by the profile of the bolster 12, as described in the detailed description of FIG. 1. It will be appreciated that the bolster 12 is shaped and dimensioned to accommodate the various portions of the body of the patient 102. Also shown are phantom views of the patient's right leg 112, the small of the back 108 and the buttocks 110.

In use, the bolster 12 is placed so that the patient's spine 104 (not shown in FIG. 4) is substantially aligned with the longitudinal center line (24 in FIG. 1) of the bolster 12 and the first end 34 of the bolster 12 is positioned proximate the lower back 108 of the patient 102. The left side of the torso of the patient 102 is placed partly on the first recessed portion 26 of the bolster and partly on the operating table 100 such that the slope of the bolster encourages the body of the patient to be tilted, or rotated to the left, substantially at a desired angle. Similarly, the patient's right hip, represented by the right buttock 110, is placed substantially on the top surface 16 of the bolster 12. The recessed portions 26, 28, and 30, along with the top surface 16 are contoured to accommodate the topography of the patient's body and provide the desired amount of elevation to the right side of the hip and right leg so that it will be tilted or rotated the required amount. The foam structure of the bolster 12 enables providing the necessary rotation in a comfortable manner. It will be appreciated that the patient's right arm may be supported by the operating table 100. In some circumstances, an arm board 114 may be attached to the edge of the operating table 100, extending away from and generally at or less than the 90 degree angle relative to the edge of the operating table, to provide support for the patient's arm.

While the invention has been shown in only one of its forms, it is not thus limited but is susceptible to various changes and modifications without departing from the spirit thereof.

What is claimed is:

1. A device for providing anatomical support during operative or therapeutic procedures, comprising:

a configurable bolster formed from a rectangular block of resilient synthetic foam material having a top reference surface and respective length, width, and height dimensions before being formed; and a plurality of recessed regions relative to the top reference surface and formed extending into selected portions of the rectangular block for accommodating particular anatomical structures wherein the plurality of recessed regions includes a first recessed portion of the top reference surface configured by a first beveled region sloping downward from a longitudinal centerline of the top surface of the bolster and descending laterally across a first half of the width dimension to and along a first side of the bolster.

2. The device of claim 1, wherein the rectangular block further includes length, width, and height dimensions before being formed of approximately 16, 9, and 3 inches respectively.

3. The device of claim 1, wherein the first recessed portion comprises:

a recessed region defined by a plane extending the full length of the bolster between the longitudinal centerline and intersecting the first side of the bolster along a longitudinal line parallel to the longitudinal centerline and located approximately ¾ of the height dimension below the top surface of the bolster.

4. The device of claim 1, wherein the plurality of recessed regions includes:

a second recessed portion of the reference surface configured as a concave relief surface sloping longitudinally downward from a first intermediate line across the top surface to a first end of the bolster and laterally downward from an intersection of the second recessed portion with the first beveled region to a second side of the bolster.

5. The device of claim 4, wherein the second recessed portion comprises:

a concavely relieved surface intersecting the first end of the bolster along a diagonal line running along the first end from an intermediate point at approximately ½ the height dimension below the top surface to intersecting the second side of the bolster at approximately ⅘ the height dimension below the top surface.

6. The device of claim 4, wherein the plurality of recessed regions includes:

a third recessed portion of the reference surface configured by a second beveled region sloping downward, descending across the second half of the width dimension, from a second intermediate line across the top surface to a second end of the bolster.

7. The device of claim 6, wherein the third recessed portion comprises:

a recess defined by a plane that extends downward between the longitudinal centerline and the second side of the bolster along approximately one-fifth of the length of the bolster from the second intermediate line bounding the top surface and intersecting the second end of the bolster along a lateral line approximately parallel to the top surface and located approximately ⅕ of the height dimension below the top surface of the bolster.

8. The device of claim 1, wherein one or more slits are cut at least approximately ½ inch deep and extending vertically upward into the resilient foam material from a bottom surface of the bolster, wherein the bottom surface of the bolster is parallel to and opposite the top surface.

9. The device of claim 8, wherein a first slit is cut along a longitudinal line parallel to the second side of the bolster and disposed inward from the second side of the bolster approximately one inch.

10. The device of claim 8, wherein a second slit is cut along a lateral line parallel to the second end of the bolster and disposed inward from the second end of the bolster approximately 1½ inches.

11. The device of claim 8, wherein a third slit is cut along a lateral line parallel to the second end of the bolster and disposed inward from the second end of the bolster approximately three inches.

12. The device of claim 1, wherein the resilient synthetic foam material is a polyurethane foam having a density within a range of approximately 2.0 to 3.0 pounds per cubic foot.

13. The device of claim 1, wherein The resilient synthetic foam material is a polyurethane foam having a density within a range of approximately 1.0 to 2.0 pounds per cubic foot.

14. The device of claim 1, wherein the bolster is configured in right and left oriented versions each being a minor image of the other defined relative to a reference line in either of the first or second sides.

15. The device of claim 1, wherein the bolster is configured in right and left oriented versions each being a minor image of the other defined relative to a reference line in either of the first or second ends.

16. A device for providing anatomical support during operative or therapeutic procedures, comprising:

a configurable bolster formed from a rectangular block of resilient synthetic foam material having a substantially rectangular top reference surface and respective length, width, and height dimensions before being formed; and further having a first recessed portion of the top reference surface configured by a first beveled region sloping downward from a longitudinal centerline of the top surface of the bolster and descending laterally across a first half of the width dimension to and along a first side of the bolster;

a second recessed portion of the reference surface configured as a concave relief sloping longitudinally downward from a first intermediate line across the top surface to a first end of the bolster and laterally downward from an intersection of the second recessed portion with the first beveled region to a second side of the bolster; and a third recessed portion of the reference surface configured by a second beveled region sloping downward, descending across the second half of the width dimension, from a second intermediate line across the top surface to a second end of the bolster.

17. The device of claim 16, wherein the rectangular block further includes length, width, and height dimensions before being formed of approximately 16, 9 and 3 inches respectively.

18. The device of claim 16, wherein the top surface comprises:

a substantially rectangular area bounded by the longitudinal centerline and the second side of the configurable bolster, and the first and second substantially parallel intermediate lines of the bolster.

19. The device of claim 16, wherein the first recessed portion comprises:

a recessed region defined by a plane extending the full length of the bolster between the longitudinal centerline and intersecting the first side of the bolster along a longitudinal line parallel to the longitudinal centerline and located approximately ¾ of the height dimension below the top surface of the bolster.

20. The device of claim 16, wherein the second recessed portion comprises:

a concavely relieved surface intersecting the first end of the bolster along a diagonal line running along the first end from an intermediate point approximately ½ the height dimension below the top surface to intersecting the second side of the bolster at approximately ⅘ the height dimension below the top surface.

21. The device of claim 16, wherein the third recessed portion comprises:

a recess defined by a plane that extends downward between the longitudinal centerline and the second side of the bolster along approximately one-fifth of the length of the bolster from the second intermediate line bounding the top surface and intersecting the second end of the bolster along a lateral line approximately parallel to the top surface and located approximately ⅕ of the height dimension below the top surface of the bolster.

22. The device of claim 16, wherein one or more slits are cut at least approximately ½ inch deep and extending vertically upward into the resilient foam material from a bottom surface of the bolster, wherein the bottom surface of the bolster is parallel to and opposite the top surface.

23. The device of claim 22, wherein a first slit is cut along a longitudinal line parallel to the second side of the bolster and disposed inward from the second side of the bolster approximately one inch.

24. The device of claim 22, wherein a second slit is cut along a lateral line parallel to the second end of the bolster and disposed inward from the second end of the bolster approximately 1½ inches.

25. The device of claim 22, wherein a third slit is cut along a lateral line parallel to the second end of the bolster and disposed inward from the second end of the bolster approximately three inches.

26. The device of claim 16, wherein The resilient synthetic foam material is a polyurethane foam having a density within a range of approximately 2.0 to 3.0 pounds per cubic foot.

27. The device of claim 16, wherein The resilient synthetic foam material is a polyurethane foam having a density within a range of approximately 1.0 to 2.0 pounds per cubic foot.

28. The device of claim 16, wherein the bolster is configured in right and left oriented versions each being a mirror image of the other defined relative to a reference line in either of the first or second sides.

29. The device of claim 16, wherein the bolster is configured in right and left oriented versions each being a mirror image of the other defined relative to a reference line in either of the first or second ends.

* * * * *